US011158981B2

(12) United States Patent
Chih et al.

(10) Patent No.: US 11,158,981 B2
(45) Date of Patent: Oct. 26, 2021

(54) COAXIAL CABLE CONNECTOR

(71) Applicant: EZCONN CORPORATION, New Taipei (TW)

(72) Inventors: Wei kai Chih, New Taipei (TW); Huang kai Wei, New Taipei (TW)

(73) Assignee: EZconn Corporation, New Taipei (TW)

( * ) Notice: Subject to any disclaimer, the term of this patent is extended or adjusted under 35 U.S.C. 154(b) by 0 days.

(21) Appl. No.: 16/900,873

(22) Filed: Jun. 13, 2020

(65) Prior Publication Data

US 2020/0395718 A1 Dec. 17, 2020

(30) Foreign Application Priority Data

Jun. 14, 2019 (TW) ..... 108207582

(51) Int. Cl.

| | |
|---|---|
| ***H01R 13/66*** | (2006.01) |
| ***H01R 24/30*** | (2011.01) |
| ***H01R 13/622*** | (2006.01) |
| ***H01R 103/00*** | (2006.01) |

(52) U.S. Cl.

CPC ..... *H01R 13/665* (2013.01); *H01R 13/622* (2013.01); *H01R 24/30* (2013.01); *H01R 2103/00* (2013.01)

(58) Field of Classification Search

CPC ..... H01R 2103/00; H01R 24/42–48; H01R 24/30; H01R 13/665; H01R 13/622

USPC ..... 439/620.03

See application file for complete search history.

(56) References Cited

U.S. PATENT DOCUMENTS

| | | | | | |
|---|---|---|---|---|---|
| 5,062,811 | A * | 11/1991 | Hackman | H01R 24/50 | 439/620.03 |
| 5,073,123 | A * | 12/1991 | Birch | H01R 9/0518 | 439/188 |
| 5,215,478 | A * | 6/1993 | Briones | H01T 4/08 | 361/119 |
| 5,340,325 | A * | 8/1994 | Pai | H01R 24/42 | 439/188 |
| 5,413,504 | A * | 5/1995 | Kloecker | H01R 24/42 | 333/182 |
| 5,598,132 | A * | 1/1997 | Stabile | H01R 24/46 | 333/22 R |
| 6,334,791 | B1 * | 1/2002 | Yeh | H01R 13/6616 | 333/185 |
| 6,712,647 | B2 * | 3/2004 | Khemakhem | H01P 1/266 | 439/133 |

(Continued)

*Primary Examiner* — Gary F Paumen

(57) ABSTRACT

A coaxial cable connector comprising an outer sleeve, a nut, at least an electronic component, and at least a passive element is provided. The outer sleeve is electrically coupled to ground and configured for mounting of a coaxial cable thereto. The nut is rotatably assembled to the outer sleeve and configured for mounting to an RF port. The at least an electronic component is electrically coupled to the outer sleeve. The at least a passive element has a proximal lead and a distal lead, both, electrically coupled thereto and extending in opposite directions thereof, electrically coupled to the at least an electronic component. The at least a passive element, at least an electronic component, and outer sleeve, form a circuit. The formed circuit is an attenuator, protection circuit, amplifier circuit, or multiplexer or any combination of the foregoing.

14 Claims, 3 Drawing Sheets

(56) References Cited

U.S. PATENT DOCUMENTS

| | | | | |
|---|---|---|---|---|
| 7,749,026 | B1 * | 7/2010 | Li | H01R 13/6658 439/620.03 |
| 8,100,721 | B2 * | 1/2012 | Yan | H01R 24/42 439/620.03 |
| 8,174,132 | B2 * | 5/2012 | Van Swearingen | H01G 4/06 257/798 |
| 2009/0269984 | A1 * | 10/2009 | Pesant | H01R 24/44 439/620.03 |
| 2015/0118897 | A1 * | 4/2015 | Paynter | H01R 24/44 333/24 C |
| 2016/0336696 | A1 * | 11/2016 | Holland | H01R 24/46 |
| 2018/0069355 | A1 * | 3/2018 | Nishimura | H01R 24/44 |

* cited by examiner

COAXIAL CABLE CONNECTOR

RELATED APPLICATIONS

The application claims the benefit of priority to Taiwan application no. 108207582, filed on Jun. 14, 2019, of which is incorporated herein by reference in its entirety.

TECHNICAL FIELD

Example embodiments relate generally to the field of communications and, more particularly, to coaxial cable connectors.

BACKGROUND

Coaxial cables continue to be used in communications, such as for hyperscale, colocation and on-premise data centers, as examples, as routers, switches, firewalls, and wireless access points, receive or transmit data via electrical current. A coaxial cable is a type of cable, generally having an inner conductor surrounded by an insulating layer, surrounded by a conductive shielding, surrounded by an insulating outer jacket, Electrical signals flow through the inner conductor.

A coaxial cable connector is an important component in communication systems, connecting the coaxial cables to ports of the routers, switches, firewalls, and wireless access points. The configuration of any coaxial cable connector may depend on a number of requirements, such as wire termination configuration, (coaxial cable to coaxial cable connectors, coaxial cable to printed circuit board connectors, etc.), operational, performance and space requirements. Some types of coaxial cable connector include F-type, N-type, BNO, TNC, SMA, MB, SMC, and BMA coaxial cable connectors.

When coaxial cables are connected to ports of the routers, switches, firewalls, and wireless access points, the inner conductor of a coaxial cable is electrically coupled to a printed circuit board of the routers, switches, firewalls, and wireless access points. In some configurations, the amplitude of the electrical signals flowing from the inner conductor is lowered via attenuators, to protect a circuit stage from receiving a signal level that is too high, or for measurement, or for impedance matching, or any combination of the foregoing. Generally, the attenuators are configured after the electrical signals leave the inner conductor of coaxial cables. Thus, additional costs are generated for the requirement and/or protection. Additionally, if required in communications equipment or devices, issues such as electrical signal loss or increased noise become problematic due to interference with circuitry on the printed circuit boards.

SUMMARY

In an embodiment, a coaxial cable connector, configured for connection to an RF port, comprising an outer sleeve, a nut, at least an electronic component, and at least a passive element is provided. The outer sleeve is electrically coupled to ground and configured for mounting of a coaxial cable thereto. The outer sleeve has a proximal outer sleeve end opening and a distal outer sleeve end opening. The nut is rotatably assembled to the proximal outer sleeve end opening of the outer sleeve and configured for mounting to an RF port. The at least an electronic component is electrically coupled to the outer sleeve. The at least an electronic component is encompassed by the nut and outer sleeve. The at least a passive element has a proximal lead and a distal lead, both, electrically coupled thereto and extending in opposite directions thereof, electrically coupled to the at least an electronic component. The at least a passive element is at least partially encompassed by the nut and outer sleeve. The at least a passive element, at least an electronic component, and outer sleeve, form a circuit.

In some embodiments, the coaxial cable connector further comprises a barrel-shaped sleeve component, electrically coupled to the outer sleeve, whereby the at least an electronic component is electrically coupled thereto. The barrel-shaped sleeve component encompasses the at least an electronic component and at least partially the at least a passive element, and encompassed by the nut and outer sleeve.

In soma embodiments, the coaxial cable connector further comprises a dielectric assembly structure, comprising a first flange portion, two supporting flange portions, and two corresponding supporting structures. The first flange portion has a first electronic component receiving slot and a first slot notch cut through corresponding to the first electronic component receiving slot. Both the first electronic component receiving slot and first slot notch cut through extend vertically within the first flange portion, from an end thereof to a center thereof. The first electronic component receiving slot is longitudinally extended vertically within the first flange portion and the first slot notch cut through is horizontally extended vertically within the first flange portion, slicing through a portion of the first electronic component receiving slot. The two supporting flange portions are correspondingly positioned on opposite sides of the first flange portion. Each of the two supporting flange portions has a slot notch cut through corresponding thereamong and to the first slot notch cut through. Each of the slot notch cut throughs is horizontally extended vertically within the two supporting flange portions, slicing through a portion of the two supporting flange portions, respectively. The two corresponding supporting structures, each, form a cavity therebetween. One two corresponding supporting structures is assembled on one side of the first flange portion and the other of the two corresponding supporting structures is assembled on an opposite side of the first flange portion. Both of the two corresponding supporting structures are assembled to the two supporting flange portions respectively.

In some embodiments, the amount of the at least a passive element is two. One of the at least a passive element is electrically coupled to the proximal lead and mounted in the cavity of the two corresponding supporting structures, whereby the proximal lead is mounted through the slot notch cut through of one of the two flange portions. The other of the at least a passive element is electrically coupled to the distal lead, whereby the distal lead is mounted through the other slot notch cut through of the other of the two flange portions. The at least an electronic component is mounted in the first electronic component receiving slot and electrically coupled to the two at least a passive elements via electrical coupling to the proximal lead. The two at least a passive element, at least an electronic component, and outer sleeve, form a circuit.

In some embodiments, the coaxial cable connector further comprises a dielectric assembly structure, comprising a first flange portion, a second flange portion and two corresponding supporting structures. The first flange, portion has a first electronic component receiving slot and a first slot notch cut through corresponding to the first electronic component receiving slot. Both the first electronic component receiving slot and first slot notch cut through extend vertically within the first flange portion, from an end thereof to a center thereof. The first electronic component receiving slot is longitudinally extended vertically within the first flange portion. The first slot notch cut through is horizontally extended vertically within the first flange portion, slicing through a portion of the first electronic component receiving slot. The second flange portion has a second electronic component receiving slot and a second slot notch cut through, corresponding to the second electronic component receiving slot. Both the second electronic component receiving slot and second slot notch cut through extend vertically within the second flange portion, from an end thereof to a center thereof. The second electronic component receiving slot is longitudinally extended vertically within the second flange portion and the second slot notch cut through is horizontally extended vertically within the second flange portion, slicing through a portion of the second electronic component receiving slot. The pair of corresponding supporting structures forms a cavity therebetween. The pair of corresponding supporting structures is assembled on a distal side of the first flange portion and a proximal side of the second flange portion.

In some embodiments, the amount of the at least a passive element is one, whereby the at least a passive element is mounted in the cavity of the pair of corresponding supporting structures. The proximal lead is mounted through the first slot notch cut through, and the distal lead is mounted through the second slot notch cut through. The amount of the at least an electronic component is two. One of the at least an electronic component is mounted in the first electronic component receiving slot and electrically coupled to the at least a passive element via electrical coupling to the proximal lead. The other of the at least an electronic component is mounted in the second electronic component receiving slot and coupled to the at least a passive element via electrical coupling to the distal lead. The at least a passive element, two at least an electronic components, and outer sleeve, form a circuit.

In an embodiment, a coaxial cable connector adapter, comprising an outer sleeve, a nut, at least an electronic component, and at least a passive element is provided. The outer sleeve is electrically coupled to ground and configured for mounting of a coaxial cable connector thereto. The outer sleeve has a proximal outer sleeve end opening and a distal outer sleeve end opening. The nut is rotatably assembled to the proximal outer sleeve end opening of the outer sleeve. The at least an electronic component is electrically coupled to the outer sleeve. The at least an electronic component is encompassed by the nut and outer sleeve. The at least a passive element has a proximal lead and a distal lead, both, electrically coupled thereto and extending in opposite directions thereof, electrically coupled to the at least an electronic component. The at least a passive element is at least partially encompassed by the nut and outer sleeve. The at least a passive element, at least an electronic component, and outer sleeve, form a circuit.

In some embodiments, the coaxial cable connector adapter further comprises a barrel-shaped sleeve component, electrically coupled to the outer sleeve, whereby the at least an electronic component is electrically coupled thereto. The barrel-shaped sleeve component encompasses the at least an electronic component and at least partially the at least a passive element, and encompassed by the nut and outer sleeve.

In some embodiments, the coaxial cable connector adapter further comprises a dielectric assembly structure, comprising a first flange portion, two supporting flange portions, and two a pair of corresponding supporting structures. The first flange portion has a first electronic component receiving slot and a first slot notch cut through corresponding to the first electronic component receiving slot. Both the first electronic component receiving slot and first slot notch cut through extend vertically within the first flange portion, from an end thereof to a center thereof. The first electronic component receiving slot is longitudinally extended vertically within the first flange portion and the first slot notch cut through is horizontally extended vertically within the first flange portion, slicing through a portion of the first electronic component receiving slot. The two supporting flange portions are correspondingly positioned on opposite sides of the first flange portion. Each of the two supporting flange portions has a slot notch cut through corresponding thereamong and to the first slot notch cut through. Each of the slot notch cut troughs is horizontally extended vertically within the two supporting flange portions, slicing through a portion of the two sup porting flange portions, respectively. The two corresponding supporting structures, each, form a cavity therebetween. One of the two corresponding supporting structures is assembled on one side of the first flange portion and the other of the two corresponding supporting structures is assembled on an opposite side of the first flange portion. Both of the two corresponding supporting structures are assembled to the two supporting flange portions, respectively.

In some embodiments, the amount of the at least a passive element of the coaxial cable connector adapter is two. One of the at least a passive element is electrically coupled to the proximal lead and mounted in the cavity of the two corresponding supporting structures, whereby the proximal lead is mounted through the slot notch cut through of one of the two flange portions. The other of the at least a passive element is electrically coupled to the distal lead, whereby the distal lead is mounted through the other slot notch cut through of the other of the two flange portions. The at least an electronic component is mounted in the first electronic component receiving slot and electrically coupled to the two at least a passive elements via electrical coupling to the proximal lead. The two at least a passive element, at least an electronic component, and outer sleeve, form a circuit.

In some embodiments, the coaxial cable connector adapter further comprises a dielectric assembly structure, comprising a first flange portion, a second flange portion and two corresponding supporting structures. The first flange portion has a first electronic component receiving slot and a first slot notch cut through corresponding to the first electronic component receiving slot. Both the first electronic component receiving slot and first slot notch cut through extend vertically within the first flange portion, from an end thereof to a center thereof. The first electronic component receiving slot is longitudinally extended vertically within the first flange portion. The first slot notch cut through is horizontally extended vertically within the first flange portion, slicing through a portion of the first electronic component receiving slot. The second flange portion has a second electronic component receiving slot and a second slot notch cut through, corresponding to the second electronic component receiving slot. Both the second electronic component receiving slot and second slot notch cut through extend vertically within the second flange portion, from an end thereof to a center thereof. The second electronic component receiving slot is longitudinally extended vertically within the second flange portion and the second slot notch cut through is horizontally extended vertically within the second flange portion, slicing through a portion of the second electronic component receiving slot. The pair of corresponding supporting structures forms a cavity therebetween. The pair of corresponding supporting structures is assembled on a distal side of the first flange portion and a proximal side of the second flange portion.

In some embodiments, the amount of the at least a passive element of the coaxial cable connector adapter is one, whereby the at least a passive element is mounted in the cavity of the pair of corresponding supporting structures. The proximal lead is mounted through the first slot notch cut through, and the distal lead is mounted through the second slot notch cut through. The amount of the at least an electronic component of the coaxial cable connector adapter is two. One of the at least an electronic component is mounted in the first electronic component receiving slot and electrically coupled to the at least a passive element via electrical coupling to the proximal lead. The other of the at least an electronic component is mounted in the second electronic component receiving slot and coupled to the at least a passive element via electrical coupling to the distal lead. The at least a passive element, two at least an electronic components, and outer sleeve, form a circuit.

In some embodiments, the at least an electronic component is at least one of a semiconductor chip, or chip resistor, or any combination of the foregoing. In some embodiments, the at least a passive element is a resistor, inductor, or capacitor or any combination of the foregoing. In some embodiments, the formed circuit is an attenuator, protection circuit, amplifier circuit, or multiplexer or any combination of the foregoing. In some embodiments, the shape of the outer sleeve is cylindrical shaped.

BRIEF DESCRIPTION OF THE DRAWINGS

Unless specified otherwise, the accompanying drawings illustrate aspects of the innovative subject matter described herein. Referring to the drawings, wherein like reference numerals indicate similar parts throughout the several views, several examples of heatsink fins incorporating aspects of the presently disclosed principles are illustrated by way of example, and not by way of limitation.

FIG. 18 is an internal schematic view of a T-pad fixed attenuator, according to an example embodiment.

FIG. 2 is a schematic exploded view of the coaxial cable connector of FIG. 2A, according to an example embodiment.

DETAILED DESCRIPTION

The following describes various principles related to communication systems by way of reference to specific examples of coaxial cable connectors, including arrangements and examples of connector assemblies, attenuator networks, and resistive elements embodying innovative concepts. More particularly, but not exclusively, such innovative principles are described in relation to selected examples of connector assemblies, attenuator networks, and resistive elements and well-known functions or constructions are be described in detail for purposes of succinctness and clarity, Nonetheless, one or more of the disclosed principles can be incorporated in various other embodiments of the coaxial cable connectors to achieve any of a variety of desired outcomes, characteristics, and/or performance criteria.

Thus, connector assemblies, attenuator networks, and resistive elements having attributes that are different from those specific examples discussed herein can embody one or more of the innovative principles, and can be used in applications not described herein in detail. Accordingly, embodiments of connector assemblies, attenuator networks, and resistive elements not described herein in detail also fall within the scope of this disclosure, as will be appreciated by those having ordinary skill in the relevant art following a review of this disclosure.

Example embodiments as disclosed herein are directed to coaxial cable connectors. In an embodiment, a coaxial cable connector comprising an outer sleeve, a nut, at least an electronic component, and at least a passive element is provided. The outer sleeve is electrically coupled to ground and configured for mounting of a coaxial cable thereto. The nut is rotatably assembled to the outer sleeve and configured for mounting to an RF port. The at least an electronic component is electrically coupled to the outer sleeve. The at least a passive element has a proximal lead and a distal lead, both, electrically coupled thereto and extending in opposite directions thereof, electrically coupled to the at least an electronic component. The at least a passive element, at least an electronic component, and outer sleeve, form a circuit. The formed circuit is an attenuator, protection circuit, amplifier circuit, or multiplexer or any combination of the foregoing.

Passive elements are used in electrical and electronic circuits to form a complete and closed circuit, individually, in combination, or with different elements. Three passive elements are resistors, capacitors, and inductors, which all limit the flow of electrical current through a circuit.

Figure 1A:
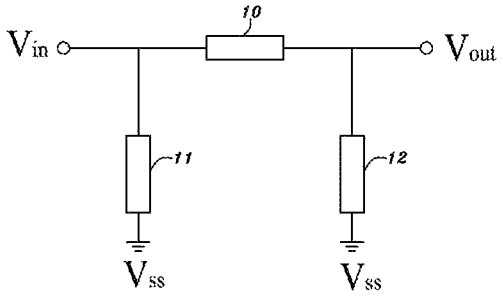
FIG. 1A is an internal schematic view of a Pi-pad fixed attenuator, according to an example embodiment.
Figure 1B:
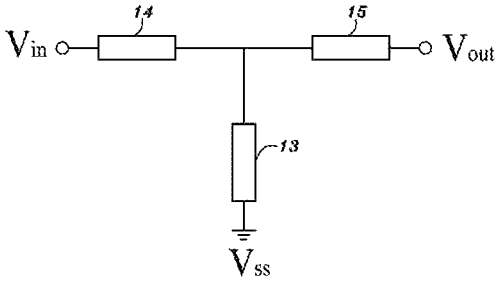

In some embodiments, the circuit of the coaxial cable connectors, as an example and not to be limiting, may be a passive attenuator Passive attenuators are electrical or electronic circuits consisting entirely of resistive elements. Generally, the resistors are of the same value when operating between circuits of equal impedance. However when operating between circuits of unequal impedance, one or more of the resistors may be of different values. A passive attenuator is a two port resistive network (or pads) designed to weaken the power being supplied by a source to a level that is suitable for the connected load. Generally, passive attenuators are used to extend the dynamic range of measuring equipment by adjusting signal levels, provide impedance matching of oscillators or amplifiers to reduce the effects of improper input/output terminations, or provide isolation between different circuit stages depending upon their application. Two types of passive attenuators are Pi-pad and T-pad attenuators. FIG. 1A is an internal schematic view of a P-pad fixed attenuator, according to an example embodiment, FIG. 1B is an internal schematic view of a T-pad fixed attenuator, according to an example embodiment. Referring to FIGS. 1A and 1B, a Pi-pad attenuator and T-pad attenuator comprises of three resistive elements (11, 12, 10 and 13, 14, 15), respectively, preventing leakage at higher frequencies. For the T-pad attenuator, the resistive elements (13, 14, 15) are arranged in the form of a T and for the Pi-pad attenuator, the resistive elements (11, 12, 10) are arranged in the form of Pi. For both the T-pad and Pi-pad attenuator, a transmission line is electrically coupled thereto from top sides thereof (resistive elements 14, 15 and resistive element 10), respectively, whereby resistive elements 14 and 15 are electrically, serially coupled to the transmission line and resistive element 13 is electrically coupled therebetween.

For both the T-pad and Pi-pad attenuator, a grounded common line is electrically coupled thereto from bottom sides thereof (resistive element 13 and resistive elements 11, 12), respectively, whereby resistive elements 11 and 12 are electrically, parallel coupled to the grounded common line and resistive element 10 is electrically coupled therebetween.

Those having ordinary skill in the relevant art may readily appreciate that other combinations and arrangements of passive elements and electronic components may result in other types of formed circuits, such as protection circuits, amplifier circuits, or multiplexers, and the embodiments are not limited thereto. As long as the at least a passive element, at least an electronic component, and outer sleeve, form the circuit.

Figure 2A:
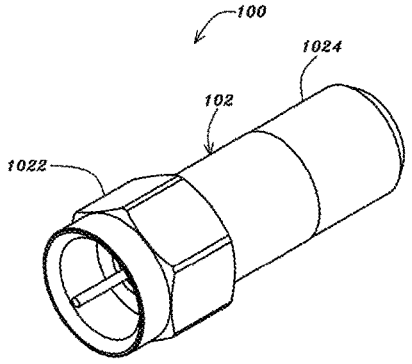
FIG. 2A is a schematic perspective view of a coaxial cable connector, according to an example embodiment.
Figure 2B:
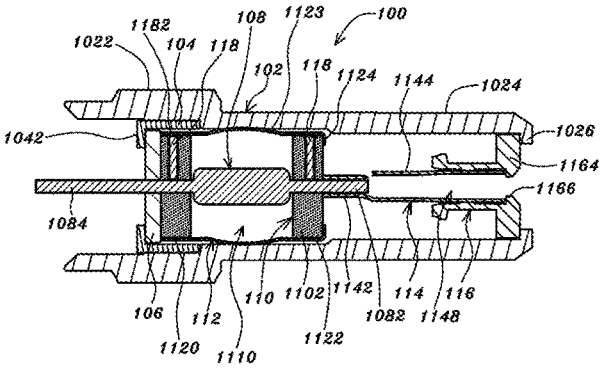
FIG. 2 is a schematic cross-sectional view of the coaxial cable connector of FIG. 2A, according to an example embodiment.
Figure 2C:
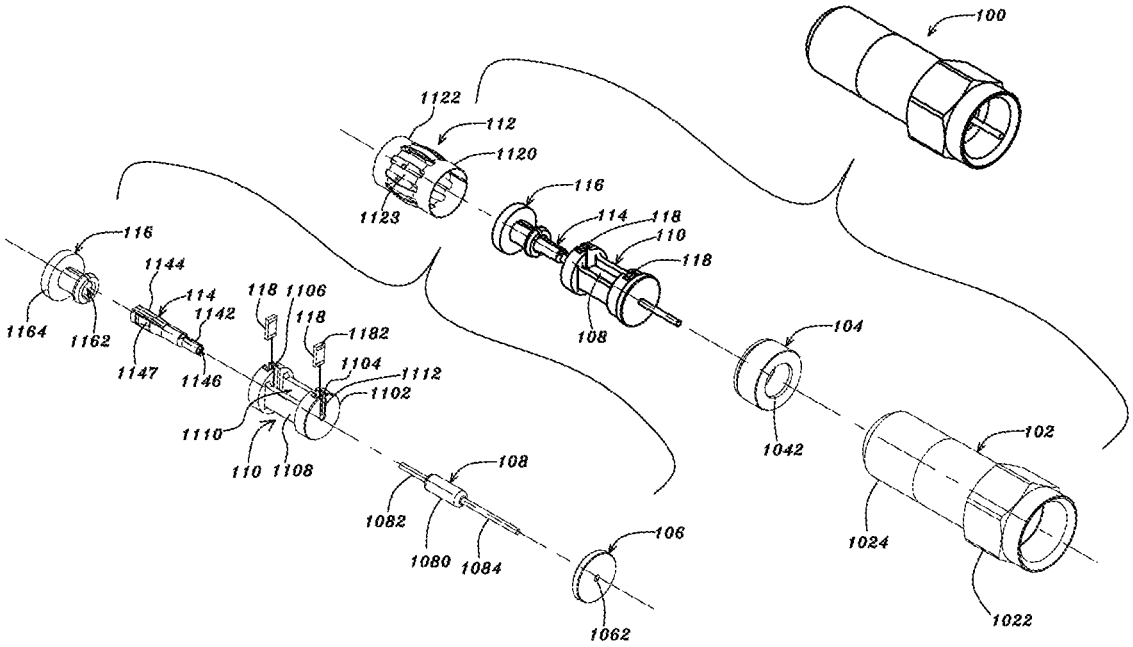

In some embodiments, the coaxial cable connectors may be applicable, as an example and not to be limiting, to communications equipment, panels, chassis' or racks, providing physical connection to networks and devices. In some embodiments, F-type, N-type, BNC, TNC, SMA, SMB, MC, and BMA compatible coaxial cables may be connected to the coaxial cable connectors of the embodiments, as examples. FIG. 2A is a schematic perspective view of a coaxial cable connector, according to an example embodiment. FIG. 2B is a schematic cross-sectional view of the coaxial cable connector of FIG. 2A, according to an example embodiment. FIG. 20 is a schematic exploded view of the coaxial cable connector of FIG. 2A, according to an example embodiment. Referring to FIGS. 2A to 2C, in an embodiment, a coaxial cable connector 100 comprising an outer sleeve 102, a nut 1022, at least an electronic component 118, and at least a passive element 108 is provided. The outer sleeve 102 is electrically coupled to ground and configured for mounting of a coaxial cable thereto. The nut 1022 is rotatably assembled to the outer sleeve 102 and configured for mounting to an RF port. The at least an electronic component 118 is electrically coupled to the outer sleeve 102. The at least a passive element 108 has a proximal lead 1084 and a distal lead 1082, both, electrically coupled thereto and extending in opposite directions thereof, electrically coupled to the at least an electronic component 118. The at least a passive element 108, at least an electronic component 118, and outer sleeve 102, form a circuit. The formed circuit is an attenuator, protection circuit, amplifier circuit, or multiplexer or any combination of the foregoing.

Referring to FIGS. 2A to 2C, in an embodiment, a coaxial cable connector 100, configured for connection to an RF port, comprising an outer sleeve 102, a nut 1022, at least an electronic component 118, and at least a passive element 108 is provided. The outer sleeve 102 is electrically coupled to ground and configured for mounting of a coaxial cable thereto. The outer sleeve 102 has a proximal outer sleeve end opening and a distal outer sleeve end opening. The nut 1022 is rotatably assembled to the proximal outer sleeve end opening of the outer sleeve 102 and configured for mounting to an RF port. The at least an electronic component 118 is electrically coupled to the outer sleeve 102. The at least an electronic component 118 is encompassed by the nut 1022 and outer sleeve 102. The at least a passive element 108 has a proximal lead 1084 and a distal lead 1082, both, electrically coupled thereto and extending in opposite directions thereof, electrically coupled to the at least an electronic component 118. The at least a passive element 108 is at least partially encompassed by the nut 1022 and outer sleeve 102. The at least a passive element 108, at least an electronic component 118, and outer sleeve 102, form a circuit.

In some embodiments, the coaxial cable connector 100 further comprises a barrel-shaped sleeve component 112, electrically coupled to the outer sleeve 102, whereby the at least an electronic component 118 is electrically coupled thereto. The barrel-shaped sleeve component 112 encompasses the at least an electronic component 118 and at least partially the at least a passive element 108, and encompassed by the nut 1022 and outer sleeve 102.

In some embodiments, the coaxial cable connector 100 further comprises a dielectric assembly structure 110, comprising a first flange portion 1102, two supporting flange portions, and two corresponding supporting structures 1108, 1108. The first flange portion 1102 has a first electronic component receiving slot 1104 and a first slot notch cut through 1112 corresponding to the first electronic component receiving slot 1104. Both the first electronic component receiving slot 1104 and first slot notch cut through 1112 extend vertically within the first flange portion 1102, from an end thereof to a center thereof. The first electronic component receiving slot 1104 is longitudinally extended vertically within the first flange portion 1102 and the first slot notch cut through 1112 is horizontally extended vertically within the first flange portion 1102, slicing through a portion of the first electronic component receiving slot 1104. The two supporting flange portions are correspondingly positioned on opposite sides of the first flange portion 1102. Each of the two supporting flange portions has a slot notch cut through corresponding thereamong and to the first slot notch cut through 1112. Each of the slot notch cut throughs is horizontally extended vertically within the two supporting flange portions, slicing through a portion of the two supporting flange portions, respectively. The two a pair of corresponding supporting structures 1108, 1108, each, form a cavity 1110 there between. One of the two corresponding supporting structures 1108, 1108 is assembled on one side of the first flange portion 1102 and the other of the two corresponding supporting structures 1108, 1108 is assembled on an opposite side of the first flange portion 1102. Both of the two corresponding supporting structures 1108, 1108 are assembled to the two supporting flange portions, respectively.

In some embodiments, the amount of the at least a passive element 108 is two. One of the at least a passive element 108 is electrically coupled to the proximal lead 1084 and mounted in the cavity 1110 of the two corresponding supporting structures 1108, 1108, whereby the proximal lead 1084 is mounted through the slot notch cut through of one of the two flange portions. The other of the at least a passive element 108 is electrically coupled to the distal lead 1082 whereby the distal lead 1082 is mounted through the other slot notch cut through of the other of the two flange portions. The at least an electronic component 118 is mounted in the first electronic component receiving slot 1104 and electrically coupled to the two at least a passive elements via electrical coupling to the proximal lead 1084. The two at least a passive element 108, 108, at least an electronic component 118, and outer sleeve 102, form a circuit.

In some embodiments, the coaxial cable connector 100 further comprises a dielectric assembly structure 110, comprising a first flange portion 1102, a second flange portion 1102 and two corresponding supporting structures 1108. The first flange portion 1102 has a first electronic component receiving slot 1104 and a first slot notch cut through 1112 corresponding to the first electronic component receiving slot 1104. Both the first electronic component receiving slot 1104 and first slot notch cut through 1112 extend vertically within the first flange portion 1102, from an end thereof to a center thereof. The first electronic component receiving slot 1104 is longitudinally extended vertically within the first flange portion 1102, The first slot notch cut through 1112 is horizontally extended vertically within the first flange portion 1102, slicing through a portion of the first electronic component receiving slot 1104. The second flange portion 1102 has a second electronic component receiving slot 1106 and a second slot notch cut through 1112 corresponding to the second electronic component receiving slot 1106. Both the second electronic component receiving slot 1106 and second slot notch cut through 1112 extend vertically within the second flange portion 1102 from an end thereof to a center thereof. The second electronic component receiving slot 1106 is longitudinally extended vertically within the second flange portion 1102 and the second slot notch cut through 1112 is horizontally extended vertically within the second flange portion 1102, slicing through a portion of the second electronic component receiving slot 1106. The pair of corresponding supporting structures 1108 forms a cavity 1110 therebetween. The pair of corresponding supporting structures 1108 is assembled on a distal side of the first flange portion 1102 and a proximal side of the second flange portion 1102.

In some embodiments, the amount of the at least a passive element 108 is one, whereby the at least a passive element 108 is mounted in the cavity 1110 of the pair of corresponding supporting structures 1108, The proximal lead 1084 is mounted through the first slot notch cut through 1112, and the distal lead 1082 is mounted through the second slot notch cut through 1112. The amount of the at least an electronic component 118 is two. One of the at least an electronic component 118 is mounted in the first electronic component receiving slot and electrically coupled to the at least a passive element 108 via electrical coupling to the proximal lead 1084, The other of the at least an electronic component 118 is mounted in the second electronic component receiving slot and coupled to the at least a passive element 108 via electrical coupling to the distal lead 1082. The at least a passive element 108, two at least an electronic component 118*s*, and outer sleeve 102, form a circuit.

In some embodiments, the circuit is formed within and a part of a coaxial cable connector; however, the embodiments are not limited thereto. The circuit may also be formed within and a part of a coaxial relay connector or coaxial cable connector adapter, and the embodiments are not limited thereto. In an embodiment, a coaxial cable connector adapter, comprising an outer sleeve 102, a nut 1022, at least an electronic component 118, and at least a passive element 108 is provided. The outer sleeve 102 is electrically coupled to ground and configured for mounting of a coaxial cable connector 100 thereto. The outer sleeve 102 has a proximal outer sleeve 102 end opening and a distal outer sleeve 102 end opening. The nut 1022 is rotatably assembled to the proximal outer sleeve 102 end opening of the outer sleeve 102. The at least an electronic component 118 is electrically coupled to the outer sleeve 102, The at least an electronic component 118 is encompassed by the nut 1022 and outer sleeve 102. The at least a passive element 108 has a proximal lead 1084 and a distal lead 1082, both, electrically coupled thereto and extending in opposite directions thereof, electrically coupled to the at least an electronic component 118. The at least a passive element 108 is at least partially encompassed by the nut 1022 and outer sleeve 102. The at least a passive element 108, at least an electronic component 118, and outer sleeve 102, form a circuit.

In some embodiments, the coaxial cable connector adapter further comprises a barrel-shaped sleeve component 112, electrically coupled to the outer sleeve 102, whereby the at least an electronic component 118 is electrically coupled thereto. The barrel-shaped sleeve component 112 encompasses the at least an electronic component 118 and at least partially the at least a passive element 108, and encompassed by the nut 1022 and outer sleeve 102.

In some embodiments, the coaxial cable connector adapter further comprises a dielectric assembly structure 110, comprising a first flange portion 1102, two supporting flange portions, and two corresponding supporting structures 1108, 1108. The first flange portion 1102 has a first electronic component receiving slot 1104 and a first slot notch cut through 1112 corresponding to the first electronic component receiving slot 1104. Both the first electronic component receiving slot 1104 and first slot notch cut through 1112 extend vertically within the first flange portion 1102, from an end thereof to a center thereof. The first electronic component receiving slot 1104 is longitudinally extended vertically within the first flange portion 1102 and the first slot notch cut through 1112 is horizontally extended vertically within the first flange portion 1102, slicing through a portion of the first electronic component receiving slot 1104. The two supporting flange portions are correspondingly positioned on opposite sides of the first flange portion 1102. Each of the two supporting flange portions has a slot notch cut through 1112 corresponding thereamong and to the first slot notch cut through 1112. Each of the slot notch cut throughs is horizontally extended vertically within the two supporting flange portions, slicing through a portion of the two supporting flange portions, respectively. The two a pair of corresponding supporting structures 1108, 1108, each, form a cavity 1110 therebetween. One of the two corresponding supporting structures 1108, 1108 is assembled on one side of the first flange portion 1102 and the other of the two corresponding supporting structures 1108, 1188 is assembled on an opposite side of the first flange portion 1102. Both of the two corresponding supporting structures 1108, 1108 are assembled to the two supporting flange portions, respectively.

In some embodiments, the amount of the at east a passive element 108 of the coaxial cable connector adapter is two. One of the at least a passive element 108 is electrically coupled to the proximal lead 1084 and mounted in the cavity 1110 of the two corresponding supporting structures 1108, 1108, whereby the proximal lead 1084 is mounted through the slot notch cut through 1112 of one of the two flange portions. The other of the at least a passive element 108 is electrically coupled to the distal lead 1082, whereby the distal lead 1082 is mounted through the other slot notch cut through 1112 of the other of the two flange portions. The at least an electronic component 118 is mounted in the first electronic component receiving slot 1104 and electrically coupled to the two at least a passive elements via electrical coupling to the proximal lead 1084. The two at least a passive element 108, 108 at least an electronic component 118, and outer sleeve 102, form a circuit.

In some embodiments, the coaxial cable connector adapter further comprises a dielectric assembly structure 110, comprising a first flange portion 1102, a second flange portion 1102 and two corresponding supporting structures 1108. The first flange portion 1102 has a first electronic component receiving slot 1104 and a first slot notch cut through 1112 corresponding to the first electronic component receiving slot 1104. Both the first electronic component receiving slot 1104 and first slot notch cut through 1112 extend vertically within the first flange portion 1102, from an end thereof to a center thereof. The first electronic component receiving slot 1104 is longitudinally extended vertically within the first flange portion 1102. The first slot notch cut through 1112 is horizontally extended vertically within the first flange portion 1102, slicing through a portion of the first electronic component receiving slot 1104. The second flange portion 1102 has a second electronic component receiving slot and a second slot notch cut through 1112 corresponding to the second electronic component notch cut through 1112 extend vertically within the second flange portion 1102, from an end thereof to a center thereof. The second electronic component receiving slot is longitudinally extended vertically within the second flange portion 1102 and the second slot notch cut through 1112 is horizontally extended vertically within the second flange portion 1102, slicing through a portion of the second electronic component receiving slot. The pair of corresponding supporting structures 1108 forms a cavity 1110 therebetween. The pair of corresponding supporting structures 1108 is assembled on a distal side of the first flange portion 1102 and a proximal side of the second flange portion 1102.

In some embodiments, the amount of the at least a passive element 108 of the coaxial cable connector adapter is one, whereby the at least a passive element 108 is mounted in the cavity 1110 of the pair of corresponding supporting structures 1108. The proximal lead 1084 is mounted through the first slot notch cut through 1112, and the distal lead 1082 is mounted through the second slot notch cut through 1112. The amount of the at least an electronic component 118 of the coaxial cable connector adapter is two. One of the at least an electronic component 18 is mounted in the first electronic component receiving slot and electrically coupled to the at least a passive element 108 via electrical coupling to the proximal lead 1084. The other of the at least an electronic component 118 is mounted in the second electronic component receiving slot and coupled to the at least a passive element 108 via electrical coupling to the distal lead 1082. The at least a passive element 108, two at least an electronic component 118*s*, and outer sleeve 102, form a circuit.

In some embodiments, the central axis of the distal lead 1082, at least a passive element 108, and proximal lead 1084 is the same as the central axis of the coaxial cable connector 100 and coaxial cable connector adapter, respectively.

In some embodiments, the coaxial cable connector 100 and coaxial cable connector adapter, each, further comprise a distal fixing sleeve insert 116, an outer sleeve extension 1024, a conducting component 114, a proximal fixing sleeve insert 104, and a dielectric oval ring 106, respectively.

The distal fixing sleeve insert 116 comprises a distal flange portion 1164 and a cylindrical extension formed on one side of the distal flange portion 1164, both, defining a distal component through hole 1148 having a central axis that is the same as a central axis of the coaxial cable connector 100 and coaxial cable connector adapter, respectively. The outer sleeve extension 1024 is integrally formed next to the distal outer sleeve end opening of the outer sleeve 102 on one end, and on an other end opposite thereof, the outer sleeve extension 1024 has an distal internal ridge 1026 defining an outer sleeve extension opening having a central axis that is the same as a central axis of the coaxial cable connector 100 and coaxial cable connector adapter, respectively. The diameter of the opening of the outer sleeve extension opening formed by the distal internal ridge 1026 is smaller than a diameter of the distal flange portion 1164, whereby the distal flange portion 1164 is watertight assembled within the outer sleeve extension 1024 and flush against an inner side of the distal internal ridge 1026.

The conducting component 114 has an inner conductor guide portion 1144 and a lead guide portion 1142, both, defining a conducting component through hole 1146 having a central axis that is the same as a central axis of the coaxial cable connector 100 and coaxial cable connector adapter, respectively, A diameter of the lead guide portion 1142 is smaller than a diameter of the inner conductor guide portion 1144 and the diameters correspond to the lead 1082 and inner conductor of a coaxial cable, respectively. In some embodiments, the inner conductor guide portion 1144 has at least an elastic position guide 1147, configured to provide a surrounding force against the inner conductor of a coaxial cable, for fixed positioning along the central axis of the coaxial cable connector 100 and coaxial cable connector adapter, respectively. The distal flange portion 1164 of the distal fixing sleeve insert 116 comprises an inner flange ridge 1166 protruding within a portion of the distal component through hole 1148. The diameter of the opening formed by the inner flange ridge 1166 is smaller than a diameter of the inner conductor guide portion 1144, whereby the inner conductor guide portion 1144 is assembled within the cylindrical extension and flush against an inner side of the inner flange ridge 1166.

The proximal fixing sleeve insert 104 has a proximal internal ridge 1042, defining a proximal sleeve through hole having a central axis that is the same as a central axis of the coaxial cable connector 100 and coaxial cable connector adapter, respectively. The dielectric oval ring 106 has an oval ring through hole 1062, having a central axis that is the same as a central axis of the coaxial cable connector 100 and coaxial cable connector adapter, respectively. The diameter of the opening formed by the proximal internal ridge 1042 is smaller than a diameter of the dielectric oval ring 106, whereby the dielectric oval ring 106 is assembled within the proximal fixing sleeve insert 104 and flush against an inner side of the proximal internal ridge 1042.

In some embodiments, the barrel-shaped sleeve component 112 of the coaxial cable connector 100 and coaxial cable connector adapter, each, comprise at least two flange mounting components 1120, 1122 and at least an elastic bilge stave 1123, respectively. The at least two flange mounting components 1120, 1122 encompass and rests flush on the first flange portion 1102, two supporting flange portions, and second flange portion 1102, whereby the at least an elastic bilge stave 1123 is integrally formed therebetween. An end of the barrel-shaped sleeve component 112 rests flush with the dielectric oval ring 106 and an other end of the barrel-shaped sleeve component 112 has at least a sleeve component inner ridge 1124, whereby an outer edge of the first flange portion 1102 or one of the two supporting flange portions lie flush against an inner side of the at least a sleeve component inner ridge 1124.

In some embodiments, the at least an elastic bilge stave 1123 is configured to provide a surrounding force against the inner walls of the outer sleeve 102, for fixed positioning therewithin and assured electrical coupling between the at least an electronic component 118, and outer sleeve 102, for forming of a circuit, respectively.

In some embodiments, the dielectric assembly structure 110 comprises a pair of supporting structures 1108: however the embodiments are not limited thereto. Those having ordinary skill in the relevant art may readily appreciate that the dielectric assembly structure 110 may comprise any suitable structure, whereby the first, second, and/or supporting flange portions are secured in position and configured such that the at least a passive element may be electrically coupled to the at least an electronic component 118, and the at least an electronic component may be electrically coupled to the outer sleeve 102, forming a circuit.

In some embodiments, the material of the outer sleeve 102, barrel-shaped sleeve component 112, and conducting component 114 are made of copper, aluminum, silver, nickel, zinc, brass or a metal alloy comprising one or more of the foregoing.

In some embodiments, the material of the dielectric assembly structure 110 and dielectric oval ring 106 is high-density polyethylene (HPE) or other polymer materials, respectively. In some embodiments, the material of the distal fixing sleeve insert 116 is rubber, polymer or silicone, preventing moisture and/or dust from entering into the coaxial cable connector 100.

In some embodiments, the at least an electronic component 11 is a chip resistor; however, the embodiments are not limited thereto. Those having ordinary skill in the relevant art may readily appreciate that any suitable chip may be employed, such as a semiconductor chip, as an example, in any combination, as long as the at least a passive element 108, at least an electronic component 118, and outer sleeve 102, form a circuit.

In some embodiments, the at least an electronic component 118 comprises electrically coupling portions 1182 on opposite sides thereof, for electrical coupling to the at least a passive element 108 and outer sleeve 102, respectively.

In some embodiments, the at least a passive element 108 is a resistor; however, the embodiments are not limited thereto. Those having ordinary skill in the relevant art may readily appreciate that any suitable passive element may be employed, such as inductors or capacitors, as examples, in any combination, as long as the at least a passive element 108, at least an electronic component 118, and outer sleeve 102, form a circuit.

In some embodiments, the amount of the at least an electronic component 118 and at least a passive element 108 is one or two, respectively; however, the embodiments are not limited thereto. Those having ordinary skill in the relevant art may readily appreciate that any suitable additional amount of electronic components and at least a passive elements may be employed via longitudinal extension of the outer sleeve 102 and/or outer sleeve extension 1024 and/or diametric extension of the outer sleeve 102 and/or outer sleeve extension 1024 diameter, as long as the at least an electronic component 118 and at least a passive element 108 and are encompassed by the outer sleeve 102 and the at least an electronic component 118, at least a passive element 108, and outer sleeve 102, form a circuit.

In some embodiments, the formed circuit is an attenuator; however, the embodiments are not limited thereto, Those having ordinary skill in the relevant art may readily appreciate that any suitable circuit may be formed, such as protection circuits, amplifier circuits, filter circuits, or multiplexers, in any combination, as long as the at least a passive element 108, at least an electronic component 118, and outer sleeve 102, form a circuit.

In some embodiments, the shapes of the outer sleeve 102, proximal fixing sleeve insert 104, dielectric oval ring 106, barrel-shaped sleeve component 112, conducting component 114 and distal fixing sleeve insert 116 are cylindrical shaped; however the embodiments are not limited thereto. Those having ordinary skill in the relevant art may readily appreciate that any suitable shape may be formed, such as a quadriateral shape for HDMI coaxial cable connectors, VGA coaxial cable connectors, Micro USB coaxial cable connectors, USB coaxial cable connector, or USB Type-C coaxial cable connectors, as examples, as long as the at least a passive element 108, at least an electronic component 118, and outer sleeve 102, form a circuit.

When coaxial cables are connected to ports of routers, switches, firewalls, and wireless access points, as examples, the inner conductor of a coaxial cable is electrically coupled to a printed circuit board of the routers, switches, firewalls, and wireless access points. In some configurations, the amplitude of the electrical signals flowing from the inner conductor is lowered via attenuators, to protect a circuit stage from receiving a signal level that is too high, or for measurement, or for impedance matching, or any combination of the foregoing. Generally, the attenuators are configured after the electrical signals leave the inner conductor of coaxial cables. Thus, additional costs are generated for the requirement and/or protection. Additionally, if required in communications equipment or devices, issues such as electrical signal loss or increased noise become problematic due to interference with circuitry on the printed circuit boards.

In the embodiments, coaxial cable connectors comprising an outer sleeve, a nut, at least an electronic component, and at least a passive element are provided. The outer sleeve is electrically coupled to ground and configured for mounting of a coaxial cable thereto. The nut is rotatably assembled to the outer sleeve and configured for mounting to an RF port. The at least an electronic component is electrically coupled to the outer sleeve. The at least a passive element has a proximal lead and a distal lead, both, electrically coupled thereto and extending in opposite directions thereof, electrically coupled to the at least an electronic component. The at least a passive element, at least an electronic component, and outer sleeve, form a circuit. The formed circuit is an attenuator, protection circuit, amplifier circuit, or multiplexer or any combination of the foregoing.

The embodiments of the coaxial cable connectors and adapters provide a circuit feature while keeping its standard coaxial cable connector footprint. The outer sleeve is electrically coupled to ground and configured for mounting of a coaxial cable thereto. The at least an electronic component is electrically coupled to the outer sleeve. The at least a passive element has a proximal lead and a distal lead, both, electrically coupled thereto and extending in opposite directions thereof, electrically coupled to the at least an electronic component. The nut is rotatably assembled to the outer sleeve and configured for mounting to an R port. F-type, N-type, BNC, TNC, SMA, SMB, SMC, and BMA compatible coaxial cables may be mounted to the outer sleeve. The at least an electronic component may be a semiconductor chip, or chip resistor, the at least a passive element may be a resistor, inductor, or capacitor, and the formed circuit may be an attenuator, protection circuit, amplifier circuit, or multiplexer. Thus, additional costs are not generated and if required in communications equipment or devices, issues such as electrical signal loss or increased noise are not problematic due to interference with circuitry on the printed circuit boards.

The presently disclosed inventive concepts are not intended to be limited to the embodiments shown herein, but are to be accorded their full scope consistent with the principles underlying the disclosed concepts herein. Directions and references to an element, such as "up," "down", "upper," "lower," "horizontal," "vertical," "left," "right," and the like, do not imply absolute relationships, positions, and/or orientations. Terms of an element, such as "first" and "second" are not literal, but, distinguishing terms. As used herein, terms "comprises" or "comprising" encompass the notions of "including" and "having" and specify the presence of elements, operations, and/or groups or combinations thereof and do not imply preclusion of the presence or addition of one or more other elements, operations and/or groups or combinations thereof, Sequence of operations do not imply absoluteness unless specifically so stated. Reference to an element in the singular, such as by use of the article "a" or "an", is not intended to mean "one and only one" unless specifically so stated, but rather "one or more". As used herein, "and/or" means "and" or "or", as well as "and" and "or." As used herein, ranges and subranges mean all ranges including whole and/or fractional values therein and language which defines or modifies ranges and subranges, such as "at least," "greater than," "less than," "no more than," and the like, mean subranges and/or an upper or lower limit. All structural and functional equivalents to the elements of the various embodiments described throughout the disclosure that are known or later come to be known to those of ordinary skill in the relevant art are intended to be encompassed by the features described and claimed herein. Moreover, nothing disclosed herein is intended to be dedicated to the public regardless of whether such disclosure may ultimately explicitly be recited in the claims. No element or concept disclosed herein or hereafter presented shall be construed under the provisions of 35 USC 112(f) unless the element or concept is expressly recited using the phrase "means for" or "step for".

In view of the many possible embodiments to which the disclosed principles can be applied, we reserve the right to claim any and all combinations of features and acts described herein, including the right to claim all that comes within the scope and spirit of the foregoing description, as well as the combinations recited, literally and equivalently, in the following claims and any claims presented anytime throughout prosecution of this application or any application claiming benefit of or priority from this application.

What is claimed is:

1. A coaxial cable connector, configured for connection to an RF port, comprising:

an outer sleeve having acne proximal outer sleeve end opening and one distal outer sleeve end opening, electrically coupled to ground, configured for mounting of one coaxial cable to the outer sleeve;

a nut, rotatably assembled to the proximal outer sleeve end opening of the outer sleeve, configured for, mounting to the RF port;

at least one electronic component, encompassed by the nut and the outer sleeve, electrically coupled to the outer sleeve;

at least one passive element having one proximal lead and one distal lead, both, electrically coupled to the at least one passive element and extending in opposite directions of the at least one passive element, at least partially encompassed by the nut and the outer sleeve, electrically coupled to the at least one electronic component; and a barrel-shaped sleeve component, encompassing the at least one electronic component and at least partially the at least one passive element, and encompassed by the nut and the outer sleeve, electrically coupled to the outer sleeve, whereby the at least one electronic component is electrically coupled to the barrel-shaped sleeve component, wherein the at least one passive element, the at least one electronic component, the barrel-shaped sleeve component, and the outer sleeve, form one circuit.

2. The coaxial cable connector of claim 1, further comprising a dielectric assembly structure, comprising:

a first flange portion having one first electronic component receiving slot and one first slot notch cut through corresponding to the first electronic component receiving slot, both, extended vertically within the first flange portion, from an end of the first flange portion to a center of the first flange portion, wherein the first electronic component receiving slot is longitudinally extended vertically within the first flange portion and the first slot notch cut through is horizontally extended vertically within the first flange portion, slicing through a portion of the first electronic component receiving slot;

a plurality of supporting flange portions, wherein the plurality of supporting flange portions is two supporting flange portions, correspondingly positioned on opposite sides of the first flange portion, each, having one slot notch cut through corresponding thereamong and to the first slot notch cut through, wherein each of the slot notch cut throughs is horizontally extended vertically within the two supporting flange portions, slicing through a portion of the two supporting flange portions, respectively; and a plurality of corresponding supporting structures, wherein the plurality of corresponding supporting structures is two corresponding supporting structures, each, forming one cavity therebetween, one of the two corresponding supporting structures, assembled on one side of the first flange portion and the other of the two corresponding supporting structures, assembled on an opposite side of the first flange portion, both, assembled to the two supporting flange portions, respectively, wherein an amount of the at least one passive element is two, whereby one of the at least one passive element, electrically coupled to the proximal lead, is mounted in the cavity of the two corresponding supporting structures, whereby the proximal lead is mounted through the first slot notch cut through of the first flange portions, and the other of the at least one passive element is electrically coupled to the at least one passive element mounted in the cavity via electrical coupling to the distal lead and wherein the at least one electronic component is mounted in the first electronic component receiving slot and electrically coupled to the at least one passive element mounted in the cavity via electrical coupling to the proximal lead, and wherein the at least one passive element, at least one electronic component, the barrel-shaped sleeve component, and the outer sleeve, form one circuit.

3. The coaxial cable connector of claim 1, further comprising a dielectric assembly structure, comprising:

a first flange portion having one first electronic component receiving slot and one first slot notch cut through corresponding to the first electronic component receiving slot, both, extended, vertically within the first flange portion, from an end of the first flange portion to a center of the first flange portion, wherein the first electronic component receiving slot is longitudinally extended vertically within the first flange portion and the first slot notch cut through is horizontally extended vertically within the first flange portion, slicing through a portion of the first electronic component receiving slot;

a second flange portion having one second electronic component receiving slot and one second slot notch cut through, corresponding to the second electronic component receiving slot, both, extended vertically within the second flange portion, from an end of the second flange portion to a center of the second flange portion, wherein the second electronic component receiving slot is longitudinally extended vertically within the second flange portion and the second slot notch cut through is horizontally extended vertically within the second flange portion, slicing through a portion of the second electronic component receiving slot; and a plurality of corresponding supporting structures, wherein the plurality of corresponding supporting structures is two corresponding supporting structures, forming one cavity therebetween, assembled on a distal side of the first flange portion and a proximal side of the second flange portion, wherein an amount of the at least one passive element is one, whereby the at least one passive element is mounted in the cavity of the two corresponding supporting structures, and the proximal lead is mounted through the first slot notch cut through, and the distal lead is mounted through the second slot notch cut through, and wherein an amount of the at least one electronic component is two, whereby one of the at least one electronic component is mounted in the first electronic component receiving slot and electrically coupled to the at least one passive element via electrical coupling to the proximal lead, and the other of the at least one electronic component is mounted in the second electronic component receiving slot and coupled to the at least one passive element via electrical coupling to the distal lead, and wherein the at least one passive element, the at least one electronic component, the barrel-shaped sleeve component, and the outer sleeve, form one circuit.

4. The coaxial cable connector of claim 1, wherein the at least one electronic component is at least one of a semiconductor chip, or chip resistor, or any combination of the foregoing.

5. The coaxial cable connector of claim 1, wherein the at least one passive element is a resistor, inductor, or capacitor or any combination of the foregoing.

6. The coaxial cable connector of claim 1, wherein the formed circuit is an attenuator, protection circuit, amplifier circuit, or multiplexer or any combination of the foregoing.

7. The coaxial cable connector of claim 1, wherein the shape of the outer sleeve is cylindrical shaped.

8. A coaxial cable connector adapter, comprising:

an outer sleeve having one proximal outer sleeve end opening and one distal outer sleeve end opening, electrically coupled to ground, configured for mounting of one coaxial cable connector to the outer sleeve;

a nut, rotatably assembled to the proximal outer sleeve end opening of the outer sleeve;

at least one electronic component, encompassed by the nut and the outer sleeve, electrically coupled to the outer sleeve;

at least one passive element having one proximal lead and one distal lead, both, electrically coupled to the at least one passive element and extending in opposite directions of the at least one passive element, at least partially encompassed by the nut and the outer sleeve, electrically coupled to the at least one electronic component; and a barrel-shaped sleeve component encompassing the at least one electronic component and at least partially the at least one passive element, and encompassed by the nut and the outer sleeve, electrically coupled to the outer sleeve, whereby the at least one electronic component is electrically coupled the barrel-shaped sleeve component, and wherein the at least one passive element, at least one electronic component, the barrel-shaped sleeve component, and the outer sleeve, form one circuit.

9. The coaxial cable connector of claim 8, further comprising a dielectric assembly structure, comprising:

a first flange portion having one first electronic component receiving slot and one first slot notch cut through corresponding to the first electronic component receiving slot, both, extended vertically within the first flange portion, from an end of the first flange portion to a center of the first flange portion, wherein the first electronic component receiving slot is longitudinally extended vertically within the first flange portion and the first slot notch cut through is horizontally extended vertically within the first flange portion, slicing through a portion of the first electronic component receiving slot;

a plurality of sup porting flange portions, wherein the plurality of supporting flange portions is two supporting flange portions, correspondingly positioned on opposite sides of the first flange portion, each, having one slot notch cut through corresponding thereamong and to the first slot notch cut through, wherein each of the slot notch cut throughs is horizontally extended vertically within the two supporting flange portions, slicing through a portion of the two supporting flange portions, respectively; and a plurality of corresponding supporting structures, wherein the plurality of corresponding supporting structures is two corresponding supporting structures: each, forming one cavity therebetween, one of the two corresponding supporting structures, assembled on one side of the first flange portion and the other of the two corresponding supporting structures assembled on an opposite side of the first flange portion, both, assembled to the two supporting flange portions, respectively, wherein an amount of the at least one passive element is two, whereby one of the at least one passive element, electrically coupled to the proximal lead, is mounted in the cavity of the two corresponding supporting structures, whereby the proximal lead is mounted through the first slot notch cut through of the first flange portions, and the other of the at least one passive element is electrically coupled to the at least one passive element r counted in the cavity via electrical coupling to the distal lead, and wherein the at least one electronic component is mounted in the first electronic component receiving slot and electrically coupled to the at least one passive element mounted in the cavity via electrical coupling to the proximal lead, and wherein the at least one passive element, at least one electronic component, the barrel-shaped sleeve component, and the outer sleeve, form one circuit.

10. The coaxial cable connector of claim 8, further comprising a dielectric assembly structure, comprising:

a first flange portion having one first electronic component receiving slot and one first slot notch cut through corresponding to the first electronic component receiving slot, both, extended vertically within the first flange portion, from an end of the first flange portion to a center of the first flange portion, wherein the first electronic component receiving slot is longitudinally extended vertically within the first flange portion and the first slot notch cut through is horizontally extended vertically within the first flange portion, slicing through a portion of the first electronic component receiving slot;

a second flange portion having one second electronic component receiving slot and one second slot notch cut through, corresponding to the second electronic component receiving slot, both, extended vertically within the second flange portion, from an end of the second flange portion to a center of the second flange portion, wherein the second electronic component receiving slot is longitudinally extended vertically within the second flange portion and the second slot notch cut through is horizontally extended vertically within the second flange portion, slicing through a portion of the second electronic component receiving slot; and a plurality of corresponding supporting structures, wherein the plurality of corresponding supporting structures is two corresponding supporting structures, forming one cavity therebetween, assembled on a distal side of the first flange portion and a proximal side of the second flange portion, wherein an amount of the at least one passive element is one, whereby the at least one passive element is mounted in the cavity of the two corresponding supporting structures, and the proximal lead is mounted through the first slot notch cut through, and the distal lead is mounted through the second slot notch cut through, and wherein an amount of the at least one electronic component is two, whereby one of the at least one electronic component is mounted in the first electronic component receiving slot and electrically coupled to the at least one passive element via electrical coupling to the proximal lead, and the other of the at least one electronic component is mounted in the second electronic component receiving slot and coupled to the at least one passive element via electrical coupling to the distal lead, and wherein the at least one passive element, at least one electronic component, the barrel-shaped sleeve component, and the outer sleeve, form one circuit.

11. The coaxial cable connector of claim 8, wherein the at least one electronic component is at least one of a semiconductor chip, or chip resistor, or any combination of the foregoing.

12. The coaxial cable connector of claim 8, wherein the at least one passive element is a resistor, inductor, or capacitor or any combination of the foregoing.

13. The coaxial cable connector of claim 8, wherein the formed circuit is an attenuator, protection circuit, amplifier circuit, or multiplexer or any combination of the foregoing.

14. The coaxial cable connector of claim 8, wherein the shape of the outer sleeve is cylindrical shaped.

* * * * *